US008770699B2

(12) United States Patent
Kato

(10) Patent No.: US 8,770,699 B2
(45) Date of Patent: Jul. 8, 2014

(54) MEDIUM CONVEY APPARATUS AND INK-JET RECORDING APPARATUS

(75) Inventor: Shigeki Kato, Toyoake (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 685 days.

(21) Appl. No.: 13/018,324

(22) Filed: Jan. 31, 2011

(65) Prior Publication Data

US 2011/0187783 A1 Aug. 4, 2011

(30) Foreign Application Priority Data

Jan. 29, 2010 (JP) ..... 2010-019282

(51) Int. Cl.
*B41J 29/38* (2006.01)

(52) U.S. Cl.
USPC ..... 347/16; 347/5

(58) Field of Classification Search
USPC ..... 347/16
See application file for complete search history.

(56) References Cited

U.S. PATENT DOCUMENTS

2004/0060467 A1* 4/2004 Kanome et al. ..... 101/480
2007/0103532 A1 5/2007 Imoto et al.

FOREIGN PATENT DOCUMENTS

CN 1496852 A 5/2004
CN 1819925 A 8/2006
EP 0535914 A2 9/1992
EP 0693381 A1 1/1996
EP 1403083 A1 3/2004
JP H07-330185 A 12/1995
JP 2000-003100 A 1/2000
JP 2009-205160 A 9/2009
WO 2005/108099 A1 11/2005

OTHER PUBLICATIONS

Japan Patent Office, Notification of Reason for Refusal for Japanese Patent Application No. 2010-019282 (counterpart to above-captioned patent application), dispatched Sep. 13, 2011.
European Patent Office, extended European Search Report for European Patent Application No. 11000583.2 (counterpart to above-captioned patent application), dated Jun. 8, 2011.
Japan Patent Office, Decision of Refusal for Japanese Patent Application No. 2010-019282 (counterpart to above-captioned patent application), dispatched Jan. 17, 2012.

(Continued)

*Primary Examiner* — Uyen Chau N Le
*Assistant Examiner* — Kajli Prince
(74) *Attorney, Agent, or Firm* — Baker & Botts L.L.P.

(57) ABSTRACT

A medium convey apparatus including: a convey mechanism including an endless belt having a medium-placed face; and a first adsorbing mechanism which includes first and second electrodes each facing a face of the convey mechanism opposite to the medium-placed face, and which adsorbs a recording medium to the medium-placed face by applying a specific voltage to between the first and second electrodes; wherein a surface layer member covers the first and second electrodes; and wherein at least one of the endless belt and the surface layer member has at least an area facing the first and second electrodes, wherein the area is formed of a resin material containing an ion conductive resistivity control material, and wherein a volume resistivity of the resin material ranges from $10^{10}$ to $10^{14}$ Ω·cm when the specific voltage is applied in an environment at a temperature of 22.5° C. and a relative humidity of 50%.

5 Claims, 4 Drawing Sheets

(56) References Cited

OTHER PUBLICATIONS

The State Intellectual Property Office of the People'S Republic of China, Notification of First Office Action for Chinese Patent Application No. 201110034287.6 (counterpart Chinese patent application), issued Dec. 6, 2012.

Japan Patent Office, Questioning for Japanese Patent Application No. 2010-19282 (counterpart to above-captioned patent application), dispatched Jul. 2, 2012.

The State Intellectual Property Office of the People'S Republic of China, Notification of the Second Office Action for Chinese Patent Application No. 201110034287.6 (counterpart Chinese patent application), mailed Aug. 28, 2013.

The State Intellectual Property Office of the People'S Republic of China, Notification of the Third Office Action for Chinese Patent Application No. 201110034287.6 (counterpart Chinese patent application), mailed Jan. 27, 2014.

* cited by examiner

MEDIUM CONVEY APPARATUS AND INK-JET RECORDING APPARATUS

CROSS REFERENCE TO RELATED APPLICATION

The present application claims priority from Japanese Patent Application No. 2010-019282, which was filed on Jan. 29, 2010, the disclosure of which is herein incorporated by reference in its entirety.

BACKGROUND OF THE INVENTION

1. Field of the Invention

The present invention relates to a medium convey apparatus and an ink-jet recording apparatus configured to convey a recording medium while adsorbing or attracting the recording medium to a convey member.

2. Description of the Related Art

There is a medium convey device configured to convey a recording medium to a recording head while adsorbing or attracting the recording medium to an endless belt. This medium convey device attracts the recording medium to a medium-placed face of the endless belt by using an electrode plate (a first electrode) and an earth plate (a second plate) disposed on a reverse side of the medium-placed face of the endless belt.

SUMMARY OF THE INVENTION

In an attract member using electrostatic action as described above, an attractive force of the recording medium depends upon a current generated in a path extending from the first electrode to the second electrode via the endless belt and the recording medium. Here, a volume resistivity of the recording medium greatly varies, e.g., from $10^7$ to $10^{14}$ Ω·cm in accordance with a type of the recording medium and/or a moisture absorbency of the recording medium. Accordingly, the current generated in the path also varies greatly in accordance with the type and/or the moisture absorbency of the recording medium, whereby the attractive force of the recording medium is unstable.

This invention has been developed in view of the above-described situations, and it is an object of the present invention to provide a medium convey apparatus and an ink-jet recording apparatus configured to convey a recording medium while stably attracting the recording medium.

The object indicated above may be achieved according to the present invention which provides a medium convey apparatus comprising: a convey mechanism including an endless belt having a medium-placed face on which a recording medium is placed, the convey mechanism being configured to convey the recording medium placed on the medium-placed face by rotating the endless belt along a predetermined path; a first adsorbing mechanism including a first electrode and a second electrode each facing a face of the convey mechanism which face is opposite to the medium-placed face, the first adsorbing mechanism being configured to adsorb the recording medium to the medium-placed face by applying a specific voltage to between the first electrode and the second electrode to generate, between the first electrode and the second electrode, a current flowing through the recording medium placed on the medium-placed face; and a surface layer member covering faces of the first electrode and the second electrode, the faces facing the face of the convey mechanism which face is opposite to the medium-placed face; wherein at least one of the endless belt and the surface layer member has at least an area facing the first electrode and the second electrode, wherein the area is formed of a resin material containing an ion conductive resistivity control material, and wherein a volume resistivity of the resin material ranges from $10^{10}$ to $10^{14}$ Ω·cm when the specific voltage is applied in an environment at a temperature of 22.5° C. and a relative humidity of 50%.

BRIEF DESCRIPTION OF THE DRAWINGS

The objects, features, advantages, and technical and industrial significance of the present invention will be better understood by reading the following detailed description of embodiments of the invention, when considered in connection with the accompanying drawings, in which.

DESCRIPTION OF THE EMBODIMENTS

First Embodiment

Hereinafter, there will be described a first embodiment of the present invention with reference to FIGS. 1 to 5.

Figure 1:
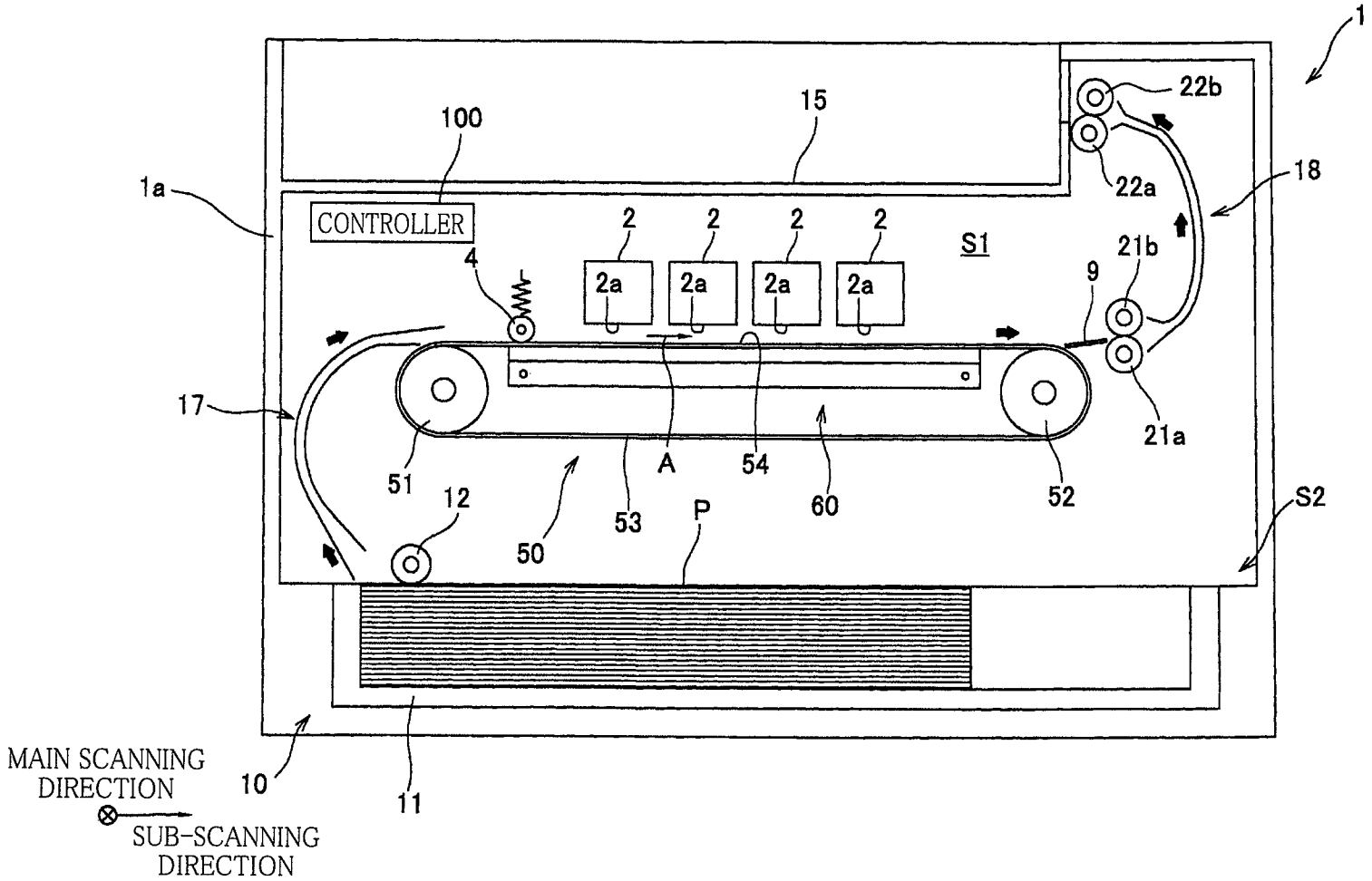
FIG. 1 is a schematic view showing an internal structure of an ink-jet printer as a first embodiment of the present invention.

As shown in FIG. 1, an ink-jet printer 1 as this first embodiment includes (a) a casing 1*a* having a rectangular parallelepiped shape and (b) a sheet-discharge portion 15 at an upper portion of the ink-jet printer 1. An inside of the casing 1*a* is divided into two spaces S1, S2 in order from above. In the space S1, there are disposed in order from the above (a) four recording heads such as ink-jet heads 2 for respectively ejecting inks of four colors, namely, magenta, cyan, yellow, and black and (b) a convey mechanism such as a sheet feeding mechanism 50 configured to feed or convey a recording medium such as a sheet P in a sheet feeding direction A. A sheet-supply device 10 is disposed in the space S2. Further, the ink-jet printer 1 includes a controller 100 configured to control operations of these components. It is noted that, in the present embodiment, a direction parallel to the sheet feeding direction A in which the sheet P is fed by the sheet feeding mechanism 50 is defined as a sub-scanning direction while a direction perpendicular to the sub-scanning direction and parallel to a horizontal plane is defined as a main scanning direction.

In the ink-jet printer 1, there is formed a predetermined sheet feeding path through which the sheet P is fed from the sheet-supply device 10 toward the sheet-discharge portion 15 along boldface arrow in FIG. 1. The sheet-supply device 10 includes (a) a sheet-supply cassette 11 configured to accommodate therein a plurality of sheets P in a stacked manner, (b) a sheet-supply roller 12 configured to supply each sheet P from the sheet-supply cassette 11, and (c) a sheet-supply motor, not shown, configured to rotate the sheet-supply roller 12 by the control of the controller 100.

The sheet-supply roller 12 supplies the sheets P one by one from an uppermost one of the sheets P accommodated in the sheet-supply cassette 11. On an upstream side of the sheet feeding mechanism 50 in the sheet feeding direction, there is provided a sheet feeding guide 17 curving and extending upward from the sheet-supply cassette 11. On a downstream side of the sheet feeding mechanism 50 in the sheet feeding direction, there is provided a peeling plate 9 for peeling the sheet P from the sheet feeding mechanism 50. On a downstream side of the peeling plate 9 in the sheet feeding direction, there are provided sheet-feed rollers 21*a*, 21*b*, a sheet feeding guide 18, sheet-feed rollers 22*a*, 22*b* for feeding or conveying the sheet P to the sheet-discharge portion 15.

In this construction, the controller 100 controls the sheet-supply roller 12 to supply the sheet P. The supplied sheet P is fed to the sheet feeding mechanism 50 through the sheet feeding guide 17. The sheet feeding mechanism 50 feeds the sheet P to an area located under the ink-jet heads 2 and facing ink-ejection faces 2*a* of the respective ink-jet heads 2. The ink-jet heads 2 respectively eject the inks onto the sheet P fed by the sheet feeding mechanism 50. As a result, an image is formed or recorded on the sheet P. The sheet P on which the image has been formed is peeled from the sheet feeding mechanism 50 at a right end (i.e., a downstream end) of the sheet feeding mechanism 50 and fed upward by the sheet-feed rollers 21*a*, 21*b*, the sheet feeding guide 18, and the sheet-feed rollers 22*a*, 22*b* to be discharged onto the sheet-discharge portion 15.

Figure 2:
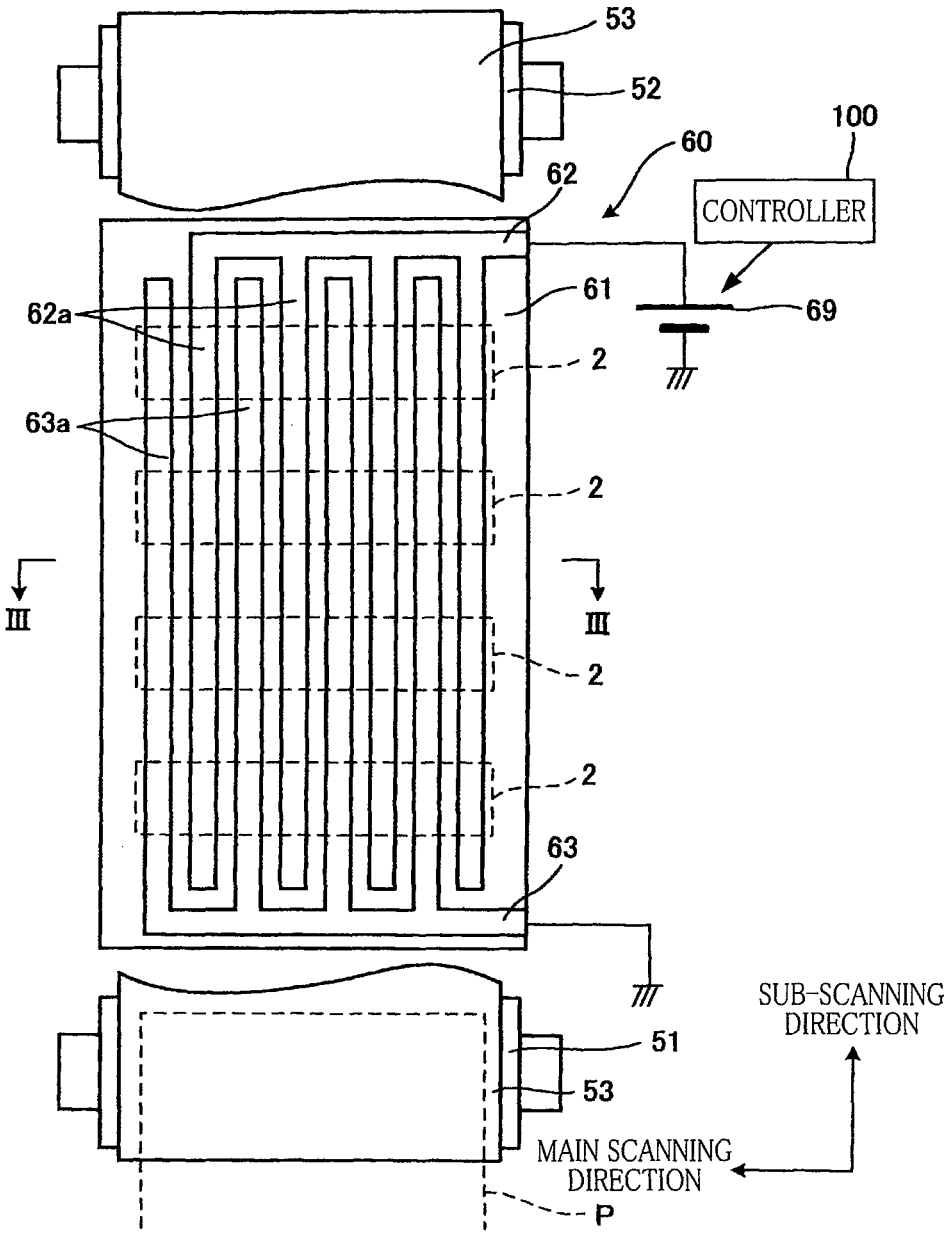
FIG. 2 is a plan view showing a sheet feeding mechanism and its surrounding components in FIG. 1, wherein illustration of a part of a sheet feeding belt and an upper portion of an adsorptive platen is partly omitted, and thereby a lower portion of the adsorptive platen is illustrated.

There will be next explained the sheet feeding mechanism 50 in more detail. As shown in FIGS. 1 and 2, the sheet feeding mechanism 50 is disposed at a position facing the four ink-jet heads 2 and includes (a) two belt rollers 51, 52, (b) a convey member in the form of an endless sheet feeding belt 53 wound around the rollers 51, 52 so as to bridge the rollers 51, 52, and (c) a sheet feeding motor, not shown, configured to rotate the belt roller 52 by the control of the controller 100. These components partly constitute a convey apparatus. The two belt rollers 51, 52 are arranged side by side in the sheet feeding direction A and supported by the casing 1*a* so as to be rotatable. The sheet feeding belt 53 is formed of a flexible material.

Figure 3:
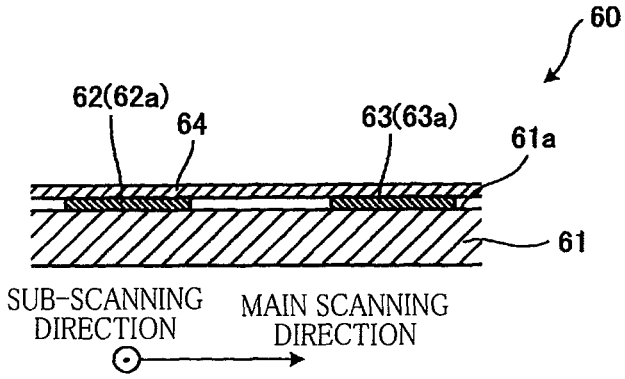
FIG. 3 is a partial enlarged view in cross section taken along line in FIG. 2.

Further, the sheet feeding mechanism 50 includes a first adsorbing mechanism in the form of an adsorptive platen 60 facing the four ink-jet heads 2. As shown in FIGS. 2 and 3, the adsorptive platen 60 includes a base member 61 having a plate shape and formed of an insulating material, and electrodes 62, 63 as a first and a second electrode bonded to an upper face 61*a* of the adsorptive platen 60. The electrodes 62, 63 respectively include a plurality of elongated portions 62*a*, 63*a* extending in the sub-scanning direction. Each of the electrodes 62, 63 has a comb-like shape such that the elongated portions 62*a* and the elongated portions 63*a* are alternately arranged in the main scanning direction. An area at which the electrodes 62, 63 are formed has about the same width as the sheet P in the main scanning direction and extends over or straddles, in the sub-scanning direction, an area at which the ink-jet heads 2 are disposed. The electrodes 62, 63 have respective upper faces formed horizontally at the same height. The electrode 62 is connected to a power source 69 provided in the casing 1*a*, and the electrode 63 is grounded. The power source 69 is controlled by the controller 100. A material having a good electric conductivity such as a metal is used for the electrodes 62, 63.

A surface layer member (material) 64 is bonded to the upper faces of the respective electrodes 62, 63. The surface layer member 64 is formed so as to bridge or straddle the electrodes 62, 63. The entire upper faces of the respective electrodes 62, 63 are covered with the surface layer member 64. As a result, surfaces of the respective electrodes 62, 63 are protected from, e.g., a wearing due to a contact of the respective electrodes 62, 63 with the sheet feeding belt 53. It is noted that FIG. 2 shows a state in which the surface layer member 64 is removed from the adsorptive platen 60.

A nip roller 4 is disposed at a position corresponding to an upstream end of the adsorptive platen 60 so as to face the elongated portions 62*a*, 63*a* of the respective electrodes 62, 63. The nip roller 4 presses the sheet P supplied from the sheet-supply device 10, onto a sheet-placed face 54 as an outer circumferential face of the sheet feeding belt 53.

Figure 4:
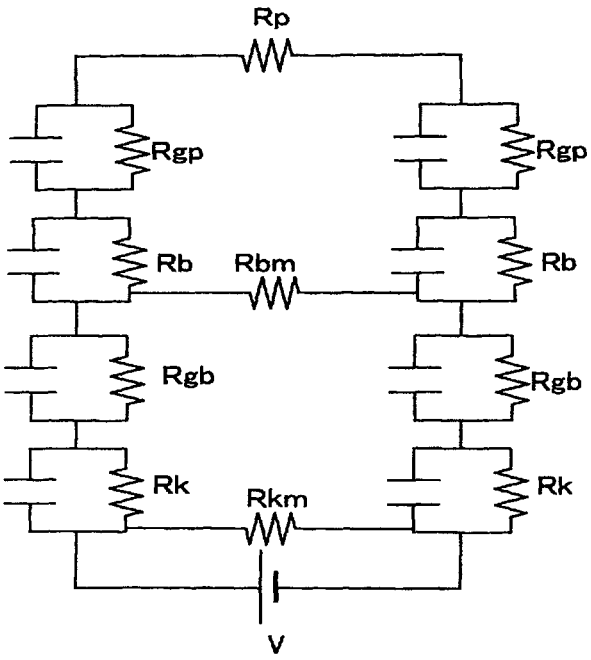
FIG. 4 is an electric circuit diagram showing an electric circuit formed by a recording medium, the adsorptive platen, and the sheet feeding mechanism.

In this construction, the belt roller 52 is rotated in a clockwise direction in FIG. 1 by the control of the controller 100, thereby rotating or circulating the sheet feeding belt 53. In this operation, the belt roller 51 and the nip roller 4 are also rotated in accordance with the rotation of the sheet feeding belt 53. The sheet P pressed onto the sheet-placed face 54 by the nip roller 4 is fed to a position on an upper side of the adsorptive platen 60 in accordance with the rotation of the sheet feeding belt 53. In the adsorptive platen 60, a positive potential is applied to the electrode 62 and a ground potential is applied to the electrode 63 by the control of the controller 100. When a voltage has been applied to between the electrodes 62, 63, the current flows to between the electrodes 62, 63 via the sheet feeding belt 53 and the sheet P. FIG. 4 shows an electric circuit formed when a voltage V has been applied to between the electrodes 62, 63. In the present embodiment, the voltage V is set at 3 kV (kilovolt) but may be set at other magnitudes. It is noted that the electric circuit shown in FIG. 4 is merely one model which is assumed where the present embodiment is idealized as an electric construction.

This electric circuit includes a path passing through the electrode 62, the sheet feeding belt 53, the sheet P, the sheet feeding belt 53, and the electrode 63 in order. Signs Rk, Rgb, Rb, Rgp, and Rp in FIG. 4 respectively denote electric resistances of respective points in this path. Specifically, the sign Rk corresponds to an electric resistance of the surface layer member 64. The sign Rgb corresponds to a contact resistance between the surface layer member 64 and the sheet feeding belt 53. The sign Rb corresponds to an electric resistance of the sheet feeding belt 53. The sign Rgp corresponds to a contact resistance between the sheet feeding belt 53 and the sheet P. The sign Rp corresponds to an electric resistance of the sheet P.

Further, this electric circuit includes alternative paths connected to the above-mentioned path in parallel. Signs Rkm and Rbm respectively denote electrical resistances of the alternative paths. Specifically, the sign Rkm denotes an electrical resistance of an alternative path directly connecting the electrodes 62, 63 to each other only via the surface layer member 64. The sign Rbm denotes an electrical resistance of an alternative path connecting a side of the electrode 62 and a side of the electrode 63 to each other not via the sheet P but via the sheet feeding belt 53. These alternative paths are paths of current flowing in the sheet feeding belt 53 and the surface layer member 64 (each having a relatively high resistance value) in their face direction. Thus, each of the resistances Rkm and Rbm is considerably high in comparison with a total of the resistances Rk, Rgb, Rb, Rgp, and Rp.

As shown in FIG. 4, a condenser connected to the electrical resistances in parallel is formed. Further, fine projections and recessions are formed on and in faces of the sheet P and the sheet feeding belt 53 which face each other. Thus, where the voltage has been applied to between the electrodes 62, 63, a minute current flows to spaces between the sheet P and the sheet feeding belt 53 at an area at which the sheet P and the sheet feeding belt 53 contact each other, whereby a potential difference is generated in these spaces. Further, electric charges having different polarities are accumulated on an area at which the sheet P and the sheet feeding belt 53 do not contact each other, so that an attractive force or an adsorptive force as a coulomb force acts on the sheet P and the sheet feeding belt 53. The sheet P on the sheet feeding belt 53 is electrostatically attracted or adsorbed to the sheet-placed face 54 by this attractive force called "Johnsen-Rahbeck force". While being attracted to the sheet-placed face 54 by the adsorptive platen 60 in this manner, the sheet P is fed through the position below the ink-jet heads 2 toward the peeling plate 9 in accordance with the rotation of the sheet feeding belt 53.

Meanwhile, the attractive force acted on the sheet P by the adsorptive platen 60 depends upon a magnitude of the electric charges accumulated between the sheet P and the sheet feeding belt 53. This magnitude of the electric charges depends upon a magnitude of the voltage applied to between the sheet P and the sheet feeding belt 53. The voltage applied to between the sheet P and the sheet feeding belt 53 depends upon a current flowing through the resistance Rgp in FIG. 4. That is, the attractive force acted on the sheet P by the adsorptive platen 60 depends upon a magnitude of a current flowing from the electrode 62 to the electrode 63 via the sheet feeding belt 53 and the sheet P. It is noted that the circuit in FIG. 4 may be considered as a series circuit including the resistances Rk, Rgb, Rb, Rgp, and Rp. This is because each of the resistances Rkm and Rbm is considerably high in comparison with a total of the resistances Rk, Rgb, Rb, Rgp, and Rp as described above, and thus a small amount of current flows through the alternative paths. Accordingly, the magnitude of the current flowing through the circuit in FIG. 4 depends upon a total of resistance values of the respective resistances Rk, Rgb, Rb, Rgp, and Rp.

Among these resistances, a resistance value of the resistance Rp of the sheet P varies greatly with properties of the sheet P such as a type of the sheet P and/or a hygroscopicity or a moisture absorbency of the sheet P. A volume resistivity of the sheet P varies with the type and/or the hygroscopicity between $10^7$ Ω·cm (ohm-cm) and $10^{14}$ Ω·cm, for example. Thus, the magnitude of the current flowing through the circuit in FIG. 4 may be changed by the variation or the change of the resistance value of the sheet P. If the magnitude of the current is fluctuated, a magnitude of the attractive force is accordingly fluctuated. This may cause a problem that the sheet P is not stably attracted to the sheet feeding belt 53. Thus, the sheet P may float up from the sheet feeding belt 53 to be brought into contact with the ink-jet heads 2 or may be fed unstably.

In order to stably attract the sheet P to the sheet feeding belt 53, the inventor of the present invention has attempted to relatively reduce an effect of the resistance value of the sheet P on the current in the circuit in FIG. 4. That is, the present inventor has believed that the effect of the resistance value of the sheet P is relatively reduced by relatively increasing the resistance values of the components other than the sheet P. For example, a material having a resistance value generally equal to or relatively larger than that of the sheet P can be considered to be used as the sheet feeding belt 53 and the surface layer member 64 in the present embodiment. Specifically, as the sheet feeding belt 53 and the surface layer member 64 is used a material adjusted to have a relatively large resistance value by incorporating a resistivity control material into the material.

An ion conductive material and an electronic conductive material can be considered to be used as the resistivity control material for the sheet feeding belt 53 and the surface layer member 64. As the ion conductive resistivity control material, ionic surface-active agent, alkali metal salt, alkaline-earth metal, organic ion electrolyte and the like may be used alone or in combination, for example. Specifically, alkyl quaternary ammonium salt is preferably used. For example, where the alkyl quaternary ammonium salt is used as the ion conductive resistivity control material for the surface layer member 64, it is possible to suppress the variation of the volume resistivity of the resistivity control material with respect to an environmental variation.

It is noted that examples of the alkyl quaternary ammonium salt include perchlorate, chlorate, hydroborofluoric acid salt, sulfate, ethosulfate salt, halogenated benzyl salt (e.g., benzyl bromide salt and benzyl chloride salt) of lauryl trimethylammonium, stearyl trimethylammonium, octadecyl trimethylammonium, dodecyl trimethylammonium, hexadecyl trimethylammonium, and the like.

Examples of the electronic conductive resistivity control material include powder of metal such as aluminum, iron, copper, and silver; metal oxide such as fiber, carbon black, titanium oxide, tin oxide, and zinc oxide; metal compound such as copper sulfide and zinc sulfide; tin oxide; antimony oxide; indium oxide; molybdenum oxide; zinc; aluminum; gold; silver; copper; chromium; cobalt; iron; lead; platinum; rhodium; and conductive polymer such as polyaniline, polypyrrole, and polyacetylene, which may be used alone or in combination. Specifically, carbon black is preferably used as the electronic conductive resistivity control material. As carbon black, powder of carbon such as ketjen black, acetylene black, carbon nano tube, fullerene, carbon for rubber, polyacrylonitrile-based (PAN-based) carbon, and pitch-based carbon is used. Using carbon black suppresses the variation of the resistivity of the resistivity control material with respect to the environmental variation.

The present inventor has found that the ion conductive resistivity control material is preferably used for at least one of the sheet feeding belt 53 and the surface layer member 64. This is because, where the ion conductive resistivity control material is used, the variation of the volume resistivity with respect to an applied voltage is small. According to a certain measurement result, where a voltage of 100V (volts) is applied to a sample of a resin material containing the electronic conductive resistivity control material, a volume resistivity of the sample is about $10^{12}$ Ω·cm, and where a voltage of 500V is applied to the sample, the volume resistivity of the sample is about $10^8$ Ω·cm. On the other hand, where a voltage of 100V is applied to a sample of a resin material containing the ion conductive resistivity control material, a volume resistivity of the sample is about $10^{13}$ Ω·cm, and where a voltage of 500V is applied to the sample, the volume resistivity of the sample is about $10^{12}$-$10^{13}$ Ω·cm.

The above-mentioned resistance values have been measured on the following measurement conditions:

- Measuring Instrument: "Hiresta UP" manufactured by Mitsubishi Chemical Corporation ("Hiresta" is a registered trademark)
- Used Probe: UR100
- Measuring Time: sixty seconds
- Measuring Environment: room temperature and humidity (temperature: 22.5° C., relative humidity: 50%). Noted that an environment at a temperature of 22.5° C. and a humidity of 50% corresponds to a main use environment assumed in the ink-jet printer 1.

As thus described, each resistivity control material has a tendency for its volume resistivity to be lowered by the application of the voltage, but the volume resistivity of the ion conductive resistivity control material is far less changed than that of the electronic conductive resistivity control material. Thus, at least one of the sheet feeding belt 53 and the surface layer member 64 is formed of the resin material containing the ion conductive resistivity control material, and the other components are formed of the electronic conductive resistivity control material or the resin material containing the ion conductive resistivity control material. In this case, the following three combinations are possible. That is, in a first combination, the sheet feeding belt 53 is formed of the electronic conductive resistivity control material, and the surface layer member 64 is formed of the ion conductive resistivity control material. In a second combination, the sheet feeding belt 53 is formed of the ion conductive resistivity control material, and the surface layer member 64 is formed of the electronic conductive resistivity control material. In a third combination, both of the sheet feeding belt 53 and the surface layer member 64 are formed of the ion conductive resistivity control material.

Among the first, second, and third combinations, the first combination is preferable. That is, it is preferable that the electronic conductive resistivity control material is used for the sheet feeding belt 53, and the ion conductive resistivity control material is used for the surface layer member 64. This is for the following reasons: where the sheet feeding belt 53 is formed of the ion conductive resistivity control material as in the second and third combinations, ion component may be bled out or bled off and attached to ink ejection openings formed in lower faces of the respective ink-jet heads 2, which may cause an ink ejection failure. For example, where the ion component of a front face (facing the ink-jet heads 2) of the sheet feeding belt 53 is attached to a back face of the sheet P and a sheet jamming is caused when an image is formed on the back face of the sheet P, the ion component may be attached to the ink ejection openings (specifically, portions of the recording heads 2 which define the ink ejection openings). Thus, the sheet feeding belt 53 is preferably formed of the electronic conductive resistivity control material. In contrast, the surface layer member 64 is disposed at a position opposite to the ink-jet heads 2 with the sheet feeding belt 53 interposed therebetween. Accordingly, even where the surface layer member 64 is formed of the ion conductive resistivity control material, the ion component bled out is less attached to the ink-jet heads 2.

For the reasons above, in the present embodiment, the sheet feeding belt 53 is formed of the resin material containing the electronic conductive resistivity control material, and the surface layer member 64 is formed of the resin material containing the ion conductive resistivity control material. Further, the resin material for the surface layer member 64 contains the ion conductive resistivity control material such that the volume resistivity of the resin material becomes $10^{10}$-$10^{14}$ Ω·cm when a specific voltage V (e.g., 3 kV) is applied to between the electrodes 62, 63 in the environment at a temperature of 22.5° C. and a relative humidity of 50%. It is noted that the voltage applied to between the electrode 62 and the electrode 63 in an environment where the ink-jet printer 1 is used is preferably 0.5-10 kV, and more preferably 1.0-5.0 kV. A type, a containing amount, and so on of the ion conductive resistivity control material incorporated into the resin material used for the surface layer member 64 are adjusted such that where such a voltage is applied to between the electrode 62 and the electrode 63, the volume resistivity of the surface layer member 64 becomes $10^{10}$-$10^{14}$ Ω·cm.

As thus described, the volume resistivity of the surface layer member 64 is relatively large and within the range from $10^{10}$ to $10^{14}$ Ω·cm. Thus, when the voltage is applied to between the electrodes 62, 63 where the volume resistivity of the sheet P is equal to or lower than $10^{10}$ Ω·cm, the effect of the resistance value of the sheet P on the current flowing through the circuit in FIG. 4 is relatively small. Accordingly, the sheet P can be stably attracted to the sheet feeding belt 53. The upper limit of the volume resistivity of the surface layer member 64 is set at $10^{14}$ Ω·cm for the following reason: since the maximum value of the volume resistivity of the sheet P is $10^{14}$ Ω·cm, the volume resistivity of the surface layer member 64 needs only to be set at about $10^{14}$ Ω·cm in order for the surface layer member 64 to suppress the effect of the resistance value of the sheet P, and on the other hand where the volume resistivity of the surface layer member 64 exceeds $10^{14}$ Ω·cm, a resistance value of the entire circuit in FIG. 4 becomes too large, and the current flowing through the circuit becomes small, so that the attractive force between the sheet P and the sheet feeding belt 53 cannot be obtained. The volume resistivity of the surface layer member 64 has the range from $10^{10}$ to $10^{14}$ Ω·cm for the following reason: when the volume resistivity is adjusted by incorporating the ion conductive resistivity control material into the resin material, a variation ranging up to about $10^{\pm 2}$ times larger than a target value of the volume resistivity normally occurs in manufacturing. Accordingly, a four-digit range whose upper limit of the volume resistivity is $10^{14}$ Ω·cm is assumed as a preferable range of the surface layer member 64.

Further, since the surface layer member 64 is formed of the resin material containing the ion conductive resistivity control material, the volume resistivity is less changed in accordance with the applied voltage. Thus, when the voltage is applied to the surface layer member 64 by the electrodes 62, 63, the volume resistivity of the surface layer member 64 is kept high, thereby stably performing the function for relatively reducing the effect of the resistance value of the sheet P.

It is noted that, as in the second or the third combination, the sheet feeding belt 53 may be formed of the resin material containing the ion conductive resistivity control material. Also in this case, at least one of the sheet feeding belt 53 and the surface layer member 64 needs only to contain the ion conductive resistivity control material such that the volume resistivity thereof becomes $10^{10}$-$10^{14}$ Ω·cm when the voltage of 3 kV is applied to between the electrodes 62, 63.

Second Embodiment

Figure 5:
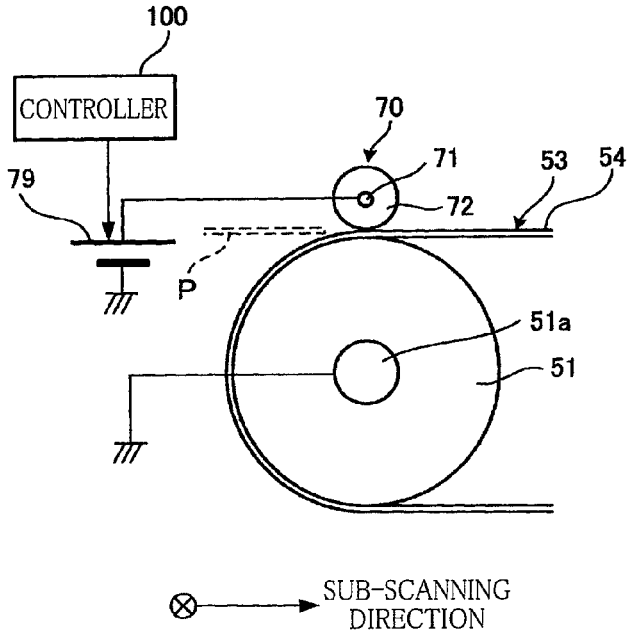
FIG. 5 is a view showing an electrically-charged roller and its surrounding components provided in a second embodiment of the present invention.

There will be next explained a second embodiment of the present invention with reference to FIG. 5. The second embodiment is different from the above-described first embodiment in that the adsorptive platen 60 as an example of a second adsorbing mechanism includes a third electrode in the form of an electrically-charged roller 70 provided instead of the nip roller 4. The other configurations in the second embodiment are the same as those in the first embodiment, and an explanation of which is dispensed with.

The electrically-charged roller 70 has a generally circular cylindrical shape whose axis extends in the main scanning direction. The electrically-charged roller 70 extends generally from one to the other of opposite ends of the sheet feeding belt 53 in the main scanning direction. As shown in FIG. 5, the electrically-charged roller 70 includes a rotation shaft 71 and a roller body 72 fixed on an outer circumferential face of the rotation shaft 71. Each of the rotation shaft 71 and the roller body 72 is formed of a material having a good electric conductivity or a semiconductive material having some degree of electric conductivity. The rotation shaft 71 is connected to a power source 79 controlled by the controller 100. A rotation shaft 51*a* of the belt roller 51 as an example of a fourth electrode is grounded. In the present second embodiment, the electrically-charged roller 70 and the belt roller 51 respectively function as a third electrode and a fourth electrode. It is noted that, although not shown in FIG. 5, the ink-jet heads 2 are disposed on a downstream side of the electrically-charged roller 70 in the sheet feeding direction A (i.e., the sub-scanning direction). That is, the electrically-charged roller 70 is disposed on an upstream side of the ink-jet heads 2 in the sheet feeding direction A.

In this configuration, the belt roller 52 is rotated in the clockwise direction in FIG. 1 by the control of the controller 100, whereby the sheet feeding belt 53 is rotated or circulated. Meanwhile, the sheet P supplied by the sheet-supply device 10 is nipped by the electrically-charged roller 70 and the sheet-placed face 54 of the sheet feeding belt 53. Here, where a certain amount of voltage is applied to the rotation shaft 71 of the electrically-charged roller 70, electric discharge is caused (electricity is discharged) from the electrically-charged roller 70 toward the sheet P, whereby the front face (facing the electrically-charged roller 70) of the sheet P becomes positively charged. This electrical charge causes a back face of the sheet P which faces the sheet feeding belt 53 to be negatively polarized and causes a face of the sheet feeding belt 53 which faces the sheet P to be positively polarized. Thus, the sheet P is electrostatically attracted to the sheet-placed face 54 of the sheet feeding belt 53. The sheet P attracted to the sheet-placed face 54 by the electrically-charged roller 70 is fed or conveyed toward the adsorptive platen 60. On the adsorptive platen 60, the sheet P is further attracted to the sheet-placed face 54 by the Johnsen-Rahbeck force. Accordingly, in the second embodiment, the sheet P is reliably attracted to the sheet-placed face 54 by the two attracting members, i.e., the adsorptive platen 60 and the electrically-charged roller 70.

Meanwhile, also in the second embodiment, it is preferable that the surface layer member 64 is formed of the ion conductive resistivity control material, and the sheet feeding belt 53 is formed of the electronic conductive resistivity control material. This is for the following reasons: where the sheet feeding belt 53 is formed of the resin material containing the electronic conductive resistivity control material, the volume resistivity of the sheet feeding belt 53 is more likely to be changed in accordance with the applied voltage. Thus, a volume resistivity of an area of the sheet feeding belt 53 which is interposed between the electrically-charged roller 70 and the belt roller 51 becomes lower than that of its surroundings by the voltage applied to between the electrically-charged roller 70 and the belt roller 51. Accordingly, since the electric discharge is more likely to be caused from the electrically-charged roller 70, and accordingly the sheet feeding belt 53 is more likely to be electrically charged, the attractive force is reliably generated. Meanwhile, since no voltage is applied to a portion of the sheet feeding belt 53 which has passed through the position interposed between the electrically-charged roller 70 and the belt roller 51, a volume resistivity of the portion of the sheet feeding belt 53 is relatively high when compared with the volume resistivity of the area of the sheet feeding belt 53 which is interposed between the electrically-charged roller 70 and the belt roller 51. Accordingly, since the electric charges once electrically charged are less likely to be moved to the outside or surrounding components, the attractive force generated by the electrically-charged roller 70 can be sustained for a relatively long time, thereby stabilizing the attractive force.

Also in the second embodiment, the surface layer member 64 is formed of the resin material containing the ion conductive resistivity control material, and the sheet feeding belt 53 is formed of the resin material containing the electronic conductive resistivity control material for the reasons explained in the second embodiment and the reasons explained in first embodiment. Further, the resin material of the surface layer member 64 contains the ion conductive resistivity control material such that the volume resistivity thereof becomes $10^{10}$-$10^{14}$ Ω·cm when the specific voltage (e.g., 3 kV) is applied to between the electrodes 62, 63. Thus, the volume resistivity of the surface layer member 64 becomes higher than the volume resistivity of the sheet P of $10^{7}$-10 Ω·cm, whereby the effect of the resistance value of the sheet P becomes relatively small in the circuit in FIG. 4, and the change of the volume resistivity of the surface layer member 64 by the applied voltage is also small. Accordingly, the attractive force acted on the sheet P is stabilized. It is noted that, also in this second embodiment, the sheet feeding belt 53 may be formed of the resin material containing the ion conductive resistivity control material as in the second or the third combination explained in the first embodiment.

Other Modifications

While the embodiments of the present invention have been described above, it is to be understood that the invention is not limited to the details of the illustrated embodiments, but may be embodied with various changes and modifications, which may occur to those skilled in the art, without departing from the spirit and scope of the invention.

In the above-described embodiments, the power source 69 is provided for applying a positive voltage to the electrode 62, but the present invention is not limited to this configuration. That is, this ink-jet printer 1 may have any configuration as long as a certain level of potential difference is generated between the electrodes 62, 63. For example, this ink-jet printer 1 may be configured such that a negative potential is applied to the electrode 62. Alternatively, this ink-jet printer 1 may be configured such that a ground potential is applied to the electrode 62, and a potential different from the ground potential is applied to the electrode 63.

In the above-described embodiments, the entire face of the adsorptive platen 60 is covered with the surface layer member 64 such that the surface layer member 64 bridges or straddles the electrodes 62, 63, but the present invention is not limited to this configuration. For example, this ink-jet printer 1 may be configured such that the upper face of the adsorptive platen 60 is partly covered with the surface layer member 64.

In the above-described embodiments, the ink-jet printer 1 has the sheet feeding path through which the sheet P is fed in only one direction from the sheet-supply device 10 to the sheet-discharge portion 15 via the sheet feeding mechanism 50, but the present invention is not limited to this configuration. For example, this ink-jet printer 1 may additionally have a return path through which the sheet P on one side of which an image has been formed is temporarily fed to a position located on a downstream side of the sheet feeding mechanism 50, and then the sheet P is fed or returned to a position located on an upstream side of the sheet feeding mechanism 50 while being turned upside down. This configuration allows two-side recording in which images are respectively formed or recorded on front and back faces of the sheet P. It is noted that, in this two-side recording, when the image is formed on the back surface of the sheet P after the image has been formed on the front face thereof, the sheet P contains moisture in an amount greater than before the image is formed on the front surface, and accordingly the resistance value of the sheet P is greatly decreased. Thus, where the present invention for relatively reducing the effect of the resistance value of the sheet P on the attractive force for attracting the sheet P to the sheet feeding belt 53 is applied to the ink-jet printer 1 which can perform such two-side recording, the sheet P can be more stably attracted to the sheet feeding belt 53.

In the above-described second embodiment, the electrically-charged roller 70 is disposed so as to face the belt roller 52, and the electric discharge is caused from the electrically-charged roller 70 to the sheet feeding belt 53 by the potential difference generated between the electrically-charged roller 70 and the belt roller 52. However, this ink-jet printer 1 may be configured such that the electrically-charged roller 70 is disposed so as to face an electrode different from the belt roller 52. For example, the electrically-charged roller 70 may be disposed so as to face the electrode 62 or 63. Further, the ink-jet printer 1 may be configured such that another electrode is provided so as to face an inner circumferential face of the sheet feeding belt 53, and the electrically-charged roller 70 is disposed so as to face said another electrode. Further, the electrically-charged roller 70 may be disposed so as not to face the sheet-placed face 54 as the outer circumferential face of the sheet feeding belt 53 but to face the inner circumferential face of the sheet feeding belt 53. Where the ink-jet printer 1 is configured in this manner, an electrode paired up with the electrically-charged roller 70 may be disposed so as to face the inner circumferential face of the sheet feeding belt 53 like the electrically-charged roller 70.

Further, the above-described embodiments are examples of the application of the present invention to the ink-jet head configured to eject the ink from the nozzles, but the present invention may be applied to ink-jet heads of other types. For example, the present invention is applicable to liquid-ejection heads of various types including: a liquid-ejection head configured to eject conductive paste to form a fine wiring pattern on a circuit board; a liquid-ejection head configured to eject organic illuminant on a circuit board to form a high-definition display; and a liquid-ejection head configured to eject optical resin on a circuit board to form a fine electronic device such as a light guide. Further, the present invention may be applied to a recording head of another type such as a thermal type.

Figure 6:
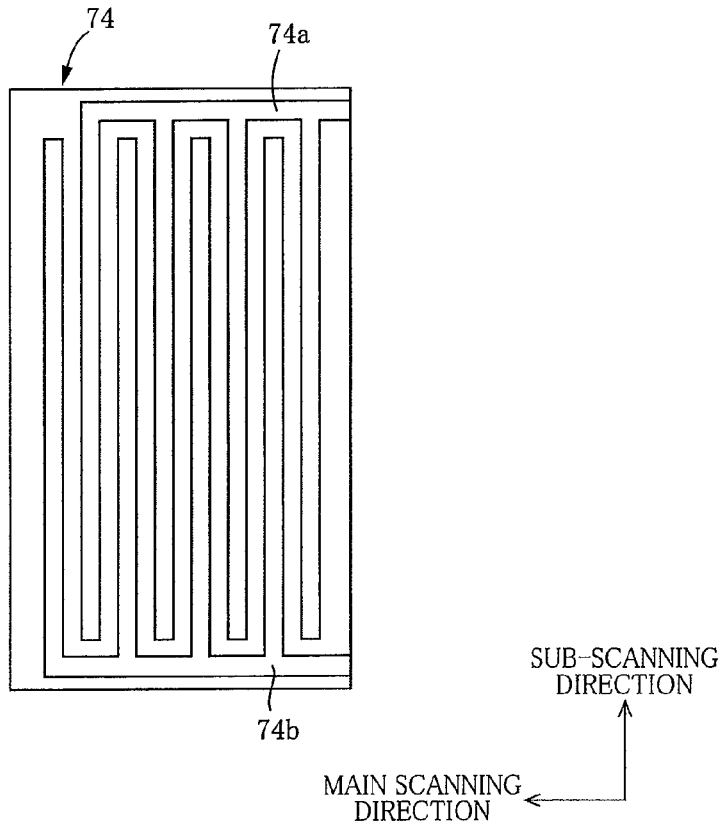
FIG. 6 is a plan view of a surface layer member used in the present invention.

In the above-described embodiments, the resin material containing the ion conductive resistivity control material is used for an entirety of the surface layer member 64, but the present invention is not limited to this configuration. For example, as shown in FIG. 6, this ink-jet printer 1 may be configured such that the resin material containing the ion conductive resistivity control material is used only for an area of the surface layer member, which area faces the electrode 62 and the electrode 63. FIG. 6 shows one form of a surface layer member used in the present invention. Specifically, FIG. 6 is a plan view of a surface layer member 74 when seen from an upper side thereof (i.e., in a direction perpendicular to the main scanning direction and the sub-scanning direction). As shown in FIG. 6, the surface layer member 74 includes an area 74*a* opposed to the electrode 62 shown in FIG. 2 and an area 74*b* opposed to the electrode 63 shown in FIG. 2. Each of the area 74*a* and the area 74*b* is an area formed of the resin material containing the ion conductive resistivity control material and formed across the surface layer member 74 from an upper face thereof (i.e., a face thereof to contact the sheet feeding belt 53) to a lower face thereof (i.e., a face thereof contacting the electrode 62 and the electrode 63). Also in the surface layer member 74 formed in this manner, when a specific voltage is applied to between the electrode 62 and the electrode 63, the area 74*a* and the area 74*b* of the surface layer member 74 each as an area through which the current flows are formed of the resin material containing the ion conductive resistivity control material, thereby suppressing an effect of a variation of the resistance value of the sheet P. Likewise, although not shown in any figures, the sheet feeding belt 53 may be configured such that the resin material containing the ion conductive resistivity control material or the electronic conductive resistivity control material is used only for an area of the sheet feeding belt 53, which area faces the electrode 62 and the electrode 63. As thus described, in the present invention, the area of the surface layer member which faces at least the electrode 62 and the electrode 63 needs only to be formed of the resin material containing the ion conductive resistivity control material, and likewise the area of the sheet feeding belt 53 which faces at least the electrode 62 and the electrode 63 needs only to be formed of the resin material containing the ion conductive resistivity control material or the electronic conductive resistivity control material. Further, this ink-jet printer 1 may be configured such that the surface layer member 64 is formed of the resin material containing the ion conductive resistivity control material, and the sheet feeding belt 53 is formed of a resin material not containing the ion conductive resistivity control material or the electronic conductive resistivity control material. Further, this ink-jet printer 1 may be configured such that the sheet feeding belt 53 is formed of the resin material containing the ion conductive resistivity control material, and the surface layer member 64 is formed of a resin material not containing the ion conductive resistivity control material or the electronic conductive resistivity control material.

What is claimed is:

1. An ink jet recording apparatus comprising:

a recording head opposed to an endless belt and configured to eject ink onto a recording medium;

a convey mechanism including the endless belt having a medium-placed face on which the recording medium is placed, the convey mechanism being configured to convey the recording medium placed on the medium-placed face by rotating the endless belt along a predetermined path;

a first adsorbing mechanism including a base member formed of an insulating material, a first electrode and a second electrode, each of the first electrode and the second electrode being bonded to an upper face of the base member and facing a back-face of the endless belt which is a back face of the medium-placed face, wherein the first adsorbing mechanism is configured to adsorb the recording medium to the medium-placed face by applying a specific voltage to the first electrode and the second electrode to generate, between the first electrode and the second electrode, a current flowing through the recording medium placed on the medium-placed face; and a surface layer member bonded to upper faces of the first electrode and the second electrode, wherein the surface layer member is disposed at a position opposite to the recording head with the endless belt interposed therebetween, and an upper face of the surface layer member faces the back-face of the endless belt, wherein the surface layer member has at least an area located on the first electrode and the second electrode, wherein the area is formed of a resin material containing an ion conductive resistivity control material, wherein a volume resistivity of the resin material ranges from $10^{10}$ to $10^{14}$ Ω·cm when the specific voltage is applied in an environment at a temperature of 22.5° C. and a relative humidity of 50%, and wherein the endless belt is formed of a resin material containing an electric conductive resistivity control material, and is not formed of the resin material containing the ion conductive resistivity control material.

2. The ink-jet recording apparatus according to claim 1, wherein the specific voltage ranges from 0.5 to 10 kV.

3. The ink-jet recording apparatus according to claim 1, wherein the specific voltage ranges from 1.0 to 5.0 kV.

4. The ink-jet recording apparatus according to claim 1, wherein the specific voltage is a voltage of 3 kV.

5. The ink jet recording apparatus according to claim 1, further comprising a second adsorbing mechanism including a third electrode and a fourth electrode each facing the endless belt and disposed on an upstream side of the recording head in a direction in which the recording medium is conveyed, the second adsorbing mechanism being configured to adsorb the recording medium to the medium-placed face by applying a voltage to between the third electrode and the fourth electrode to cause an electric discharge between (a) at least one of the third electrode and the fourth electrode and (b) one of the endless belt and the recording medium placed on the endless belt.

* * * * *